US005972037A

United States Patent [19]

Scheen

[11] Patent Number: 5,972,037

[45] Date of Patent: Oct. 26, 1999

[54] LEATHER TANNING PROCESSES AND THE PRODUCTS THEREOF

[75] Inventor: Hans J. Scheen, Seattle, Wash.

[73] Assignee: Scheen Industries, Inc, Seattle, Wash.

[21] Appl. No.: 08/506,905

[22] Filed: Jul. 26, 1995

[51] Int. Cl.[6] ..... C14C 9/00; C14C 11/00

[52] U.S. Cl. ..... 8/94.21; 8/94.18; 8/94.2; 8/94.22; 8/94.23; 8/94.25; 8/94.26; 8/94.27; 8/94.3; 8/94.32; 8/94.33; 252/8.57

[58] Field of Search ..... 8/94.18, 94.2, 8/94.21, 94.22, 94.23, 94.25, 94.26, 94.27, 94.3, 94.32, 94.33; 252/8.57

[56] References Cited

U.S. PATENT DOCUMENTS

| | | | |
|---|---|---|---|
| 3,888,625 | 6/1975 | Dawson | 8/94.27 |
| 4,701,269 | 10/1987 | Bay et al. | 252/8.57 |
| 4,780,222 | 10/1988 | Amati | 252/8.57 |
| 4,961,750 | 10/1990 | Christner et al. | 8/94.27 |
| 4,999,024 | 3/1991 | Scheen | 8/94.26 |

OTHER PUBLICATIONS

Thorstensen, Practical Leather Technology, 1976, p. 237.
Material Safety Data Sheet, Tergotan EFB, 284002, Sandoz Chemicals Corporation, Feb. 2, 1993.
Material Safety Data Sheet, Tergotan MC–N, 262493, Sandoz Chemicals Corporation, Feb. 26, 1993.
Material Safety Data Sheet, DERMALIX C, 240352, Sandoz Chemicals Corporation, Feb. 10, 1995.
Material Safety Data Sheet, L–80, Salem Oil & Grease Co. (Date Unknown).
Material Safety Data Sheet, Basyntan DLE, 510211, BASF Corporation (Date Unknown).
Material Safety Data Sheet, Chromitan, 595072, BASF Corporation (Date Unknown).
Material Safety Data Sheet, Ombrophob M, 238072, Sandoz Chemicals Corporation, Mar. 30, 1995.
Material Safety Data Sheet, Catalix GS, 233612, Sandoz Chemicals Corporation Mar. 30, 1995.
Material Safety Data Sheet, Densodrin S, 512618, BASF Corporation (Date Unknown).

*Primary Examiner*—Alan Diamond
*Attorney, Agent, or Firm*—Richard D. Multer

[57] ABSTRACT

The production of household-machine washable and dryable, waterproof, nonflammable, and extremely colorfast leathers from wet blue hides by a process which has the advantage that significantly reduced volumes of toxic wastes are generated. The wet blue hides are washed and treated to equalize the pH at the surface and in the interior of the leather and to build at least one wanted end characteristics such as suppleness into the leather. This is followed by the introduction of additional character builders into the pores of the hide and the substitution of one or more softening agents for fats originally present in the pores of the hide. Next in a typical application of the invention are dyeing and the fixing of previously introduced substances in the pores of the hide. This is followed by refloatation with a hydrophobic waterproofing agent and buffering for pH equalization and increase of the pH. The hides are next treated to impart a pleasing, silky feel to the leather into which the hides are being converted and a hydrophobic silicone which promotes waterproofability and washability; and this is followed by a second fixing step.

21 Claims, No Drawings

LEATHER TANNING PROCESSES AND THE PRODUCTS THEREOF

TECHNICAL FIELD OF THE INVENTION

The present invention relates to novel, improved processes for tanning hides and to equally novel and improved leathers made by using those processes.

DEFINITIONS

Wet Blue Hide—A hide which has been cured, freed of excess hair and flesh, in some cases treated to remove fatty substances from the pores of the hides, and given a prime tan.

Float—The aqueous liquid in which a hide is processed in a tanning vat. Except in washing and rinsing steps, chemicals are added to the float to change characteristics of the hide and/or to impart additional characteristics to the hide.

BACKGROUND OF THE INVENTION

"Tanning" is a process for treating animal hides which employs metal salts or substances found in plants and called tannin or a combination of metal salts and tannin. Tannin and metal tanning salts cause changes in the skins which make the skins resistant to decomposition; flexible; and very strong, which greatly improves their wear resistance. The tanned hides are called leather.

Tanning processes have been employed for many centuries to dress and preserve animal hides or skins. The treated skins are widely used for footwear, clothing, upholstery, sports equipment, saddlery, and many other items.

In conventional tanning processes, freshly split animal hides or skins are initially cured—typically by salting and/or drying—to prevent decay. These skins are treated to remove loose flesh and excess hair, typically by soaking them in a water bath containing enzymes and sometimes other chemical additives. The pretreated skins, commonly referred to as pelts, are bated by soaking them in an appropriate solution formulated to soften the pelts, to further remove excess proteins, and to improve color. In some cases, fatty substances are also leached out by additional soaking in solvent and/or detergent based solutions. The pelts are then chemically treated in vats with selected tanning agents of vegetable or mineral origin for conversion into leather. The leather is frequently treated with oils or fats or other lubricating agents to obtain soft and supple characteristics; and this is followed by appropriate dyeing, drying, and finishing steps.

The cleaning of such conventionally produced leathers can be difficult or impossible because leathers made by conventional tanning processes do not stay soft and compliant when wetted with water or water-based solutions of the type used for washing traditional woven fabrics. Instead, when wetted, leather products exhibit a tendency to become stiff and/or brittle as they dry with cracks or splits often occurring. Moreover, permanent discoloration and/or stains can occur when a conventional leather is wetted with water. As a result, cleaning techniques for leather have generally been limited to relatively costly dry cleaning processes employing organic solvents.

Attempts have been made to permit at least some contact of leathers with water without significant adverse consequences. For example, there are specially treated suede leathers somewhat capable of withstanding occasional spot cleaning with water-based solutions with only minimal change to surface characteristics or color. Other leathers have been treated during post-tanning processes with specialized oil formulations to enhance their resistance to water penetration and damage. However, even these leather products are not capable of withstanding repeated washing in water in the manner used for cleaning traditional woven fabrics.

U.S. Pat. No. 4,999,024 discloses a novel tanning process capable of producing leathers which, in contrast to even those made by the specialized treatment of conventionally tanned leathers, can be washed in water without cracking, drying out, or otherwise deteriorating. Instead, the leathers made by the patented process are soft, supple, and compliant and retain these characteristics, even after repeated washing.

The process disclosed in the '024 patent employs a preliminary step in which hides are impregnated with a grease/oil lubricating solution. the impregnated skins are then preserved by tanning to produce a soft and supple leather. Residual lubricating solution in the pores of the leather keeps the leather supple even after repeated washing in water.

Optimum results are obtained by starting with relatively thick skins having a well developed pore structure. The skins are typically split and cured by salting and/or drying. These skins are subjected to a preliminary cleaning step including tumbling in a bath of cold water. The tumbled skins are placed in a water-based bath containing a grease/oil lubricating solution designed to penetrate and impregnate the pores of the skins. The skins are tumbled in the lubricating solution at an elevated temperature, causing the pore structure of the skin to swell and absorb substantial quantities of the lubricating solution. Optimum results are obtained by first tumbling the skins in the heated bath and then allowing the skins to stand in the bath for at least several hours.

The thus-treated skins are removed from the lubricating solution bath, drained, and bated by tumbling them in a mild acid salt solution. Appropriate enzymes are normally added to the bating medium to assist in softening the skins and in removing excess proteins.

The bated skins are rinsed and tanned, preferably with a sequence of mineral and vegetable tanning agents. The result is leathers having a substantially closed pore structure with the absorbed lubricating solution trapped in the pores.

After the last (typically vegetable) tanning step, the skins are tumbled again in a water-based grease/oil lubricating solution containing additional lubricating agents to ensure that the leather is soft and supple. The resultant leather is drained and then finished in a conventional manner.

U.S. Pat. No. 4,999,024 is hereby incorporated by reference in and made a part of this specification.

SUMMARY OF THE INVENTION

There have now been invented and disclosed herein certain new and novel tanning processes which have advantages over even that state-of-the-art process disclosed in the '024 patent. In particular, the herein disclosed tanning processes are capable of producing leathers which are washable and dryable even in common household appliances and, in addition, are waterproof, nonflammable, and extremely colorfast. Another important advantage of these novel processes is that the volume of toxic discharges generated in tanning hides is significantly reduced.

The novel tanning process disclosed herein, like that disclosed in the '024 patent, starts with pretreated hides—i.e., with hides which have been cured, freed of flesh and excess hair, and treated by chrome tanning or an equivalent process. These prime tanned hides are referred to in the industry as pelts or wet blue hides.

In the practice of the present invention, the wet blue hides are washed and rinsed in lukewarm water to remove chemicals with which the hides have previously been treated. Next are buffering and character building steps which equalize the pH at the surface (i.e., the outer and flesh sides) and in the interior of the leather and build wanted characteristics such as suppleness into the hides.

Retanning of the hides is continued by treating them with additional character builders to enhance and impart additional desirable characteristics to the hides. The hides are then washed and refloated at a mildly elevated temperature to substitute a softening agent for fat removed from the pores of the hides in a previous process step or steps. In a typical application of the present invention the refloat step is followed by treatment in a water-based solution (a term employed herein to include dispersions, colloidal suspensions, etc. as well as true solutions) of additional softening agents to optimize the feel which the leather will have and a dyeing step to impart the wanted color to the leather. Next are steps which fix the previously added chemical or additives in place in the leather and refloatation with a hydrophobic waterproofing agent. These steps are followed by buffering for pH equalization and increase of the pH to an appropriate level. Then, the hides are washed, rinsed, and treated with an additive selected to impart a pleasing silky feel to the leather into which the hides are being converted. This step is followed by treatment with a hydrophobic silicone to promote waterproofability and washability; a second fixing step; and a final rinse of the processed hides.

All of the just-described steps need not be employed in every application of the invention. Those steps that are considered essential and thus always employed are those of: treating the hide with a pH equalizer and a character builder selected to develop characteristics wanted in the leather; treating the hide with a softening agent to soften the hide and thereby improve the feel of the leather into which the hide is converted; treating the hide with an organic hydrophobe to impart water repellency; and treating the hide with a cationic topping oil in an amount effective to impart a pleasant tactile character.

The important objects, features, and advantages of the invention will be apparent to the reader from the foregoing, the appended claims, and the ensuing detailed description and discussion of the invention.

DETAILED DESCRIPTION OF THE INVENTION

The novel, improved process disclosed herein can be applied to a variety of types and grades of animal hides or skins such as cattle, pig, sheep, deer and elk, goat, reptile, fish, etc. It is preferred that the skins have a relatively well developed grain or pore structure to optimize absorption of various agents with which the skins are treated. Relatively aged skins are normally preferred for this same reason. For best results, only skins of approximately uniform density and thickness are processed in the same batch.

As mentioned above, the selected hides are normally split; treated to remove excess flesh material and hair; and cured, typically by drying and/or salting them to at least minimize preprocessing decay. The thus pretanned skins are cleaned to remove foreign material and chemicals employed in pretanning by washing them in cold water for a selected time period, typically on the order of about one-half to one hour. This washing step can be repeated as necessary with intervening draining and rinsing of the hides. The preliminary washing step or steps, as well as the subsequent process steps described below, are carried out in traditional tanning vats having driven paddles for tumbling the skins in the tanning vat and agitating the various treating solutions.

The next step of equalizing the interior and exterior pH's of the hides and retanning the hides to build character is carried out by floating the hides in a solution containing a buffering agent and a tanning agent, preferably one of vegetable origin such as chestnut powder. This step is carried out in the tanning vat at a temperature of 80 to 110° F. for a period of 25 to 45 minutes.

pH equalization and retanning is followed by a step which continues the retanning of the hides being processed to build into the hides characteristics such as suppleness wanted in the leather being produced. The active ingredients in the retanning solution are added to the solution in which the hides are processed in the preceding steps, and the temperature is kept the same. The retanning agents may be a combination of TERGOTAN EFB and TERGOTAN MC, both products supplied by Sandoz Chemicals Corporation.

The chemical family of TERGOTAN EFB, which is also employed to some extent as a filler, is amino acids; and this liquid product contains sodium salts of protein hydrolysates; formaldehyde; and a mixture of hydrocarbons, ethers, and ketones. TERGOTAN MC-N is also a liquid and has a proprietary formulation. It is dilutable in water and contains acrylic polymers.

In the step just described and employed to continue the retanning of the hides, the hides are tumbled in the retanning solution for 25 to 40 and typically 30 minutes.

After the continued retanning step, the hides are washed in water until clean, which typically takes 10–15 minutes, at a temperature in the range of 90 to 110° F. and typically 100° F.

Once the wash and rinse water has been drained from the tanning vat, the hides are floated with a solution containing a softening agent. The softening agent replaces fat removed from the pores of the hides in previous process steps and impartments suppleness and other pleasing tactile characteristics to the hides. DERMALIX C (Sandoz Chemicals Corporation) is a preferred softening agent because of its compatibility with the treatment agents employed to make the hides washable and waterproof.

DERMALIX C is a paste with a proprietary formulation, and it belongs in the chemical family of alkyl phosphate ester amine salts. This product contains ethylene and diethylene glycols, petroleum distillates, and glycol ethers.

This step in which a softening agent is introduced into the pores of the hides being treated is carried out at a modestly elevated temperature—122 to 140° F. and typically 130° F.—to promote penetration of the softening agent into the pores of the hides. The hides are floated in the softening agent solution for a period of 30 to 45 and typically 30 minutes.

Particularly for garments, softer leathers are preferred. These can be readily produced by adding a second softening agent such as L-80 (Salem Oil & Grease Co.) to the solution with which the hides are floated in the softening step. This product is an amber oily liquid with a pleasant aromatic odor.

In a typical application of the invention, the hides are dyed while they are being floated with the solution containing the softening agent(s) with this step being omitted if a leather of natural color is wanted. A variety of leather dyes and the techniques for utilizing them are well-known and commercially available, and appropriate ones of these can be readily selected by those skilled in the arts to which this specification is addressed. The dye is added to the float solution containing the softening agent in a concentration dependent upon the dye being employed but typically on the order of two percent.

A penetration aid may be added to the float solution during the 30-minute (or other duration) dye cycle to ensure that the dye penetrates through the pore structures of the hides. One appropriate penetration aid is concentrated ammonium hydroxide. This compound can be employed in a concentration of 0.5 to 2.5 percent with a 2 percent concentration being typical.

Subsequently added to the float solution in the tanning vat in a representative application of the invention are a fixing agent or a combination of fixing agents. The fixing agent permanently establishes in the pores of the hides being treated chemicals introduced into those pores in previous process steps such as softening agents, other character builders, and dyes. Preferred for typical applications is a combination of fixing agents with different fixation mechanisms—typically acid fixation and metal salt fixation. The three fixation agents are added separately to the float.

Formic acid is a representative acid fixation compound. That compound is typically employed in a concentration of 0.5 to 2.5 and typically 2 percent. Preferred mineral fixing agents are BYSANTAN DLE (BASF Corporation) and CHROMITAN FM (BASF Corporation). The first-identified fixing agent is a proprietary liquid product containing formic acid, methanol, phenol, and ammonium sulfate, and CHROMITAN FM contains chromium hydroxide sulfate and sodium formate. The float is continued for 30 to 60 (typically 60) minutes after the first fixing agent such as BYSANTAN DLE is added, for 10 to 15 (typically 15) minutes after the second fixing constituent such as the acid fixation agent formic acid is added, and for 15 to 30 (typically 30) minutes after the third fixing constituent such as the chrome salt fixation agent CHROMITAN FM is added. The formic acid is divided into three equal moieties. These moieties are added at equal—5–10 (typically 10) minute—intervals to the float. The float solution can be kept at the same temperature over the course of the just-described character building (softening), dyeing, and fixing steps.

Once these steps are completed, the tanning vat is drained, and the hides are washed and rinsed in clean room temperature water to remove excess process chemicals with the water being drained from the tanning vat after each step. The hides are tumbled in the wash and rinse waters for 5 to 10 and typically 5 minutes until clean.

The clean hides are waterproofed by introducing a waterproofing agent into, and permanently fixing it in, the pore structure of the hide being processed. Preferred is a hydrophobic composition capable of imparting water buoyancy to the hides as well as waterproofing them. One preferred product is OMBROPHOB M, a proprietary liquid product supplied by Sandoz Chemicals Corporation. It contains a metallized organic compound with the formula $C_{14}H_{20}Cl_4Cr_2O_3$, hydrochloric acid, and acetone. In this step of the tanning process, the float is maintained at room temperature for a period of 50 to 70 (typically 60) minutes.

After the waterproofing step, a pH equalizing agent such as the above-discussed sodium formate is added to the solution in the tanning vat to again ensure that the pH of the hides being process is uniform throughout the structure of the hides and to raise the pH of the hides which is very low (e.g., ca. 2.8–3.0) after treatment with a chrome salt fixation agent such as the above-discussed CHROMITAN FM. The sodium formate is typically employed in a somewhat lower concentration (0.7 percent as opposed to one percent in the pH equalization and elevation step). The hides are floated at room temperature until the selected pH (typically 3.5) is reached—typically 25 minutes after the pH equalization and adjusting agent is added to the solution in the tanning vat.

Next, the hides are washed and rinsed in warm water until clean.

In the next stage of the process, the clean hides are treated sequentially in the same float with: a character building agent selected to impart a smooth, silky, even slick feel; a second waterproofing agent; and a fixative selected to permanently retain processing agents added to the hides since the previous fixation step in the pore structure of the hides. The character builders preferred at this step of the process are cationic topping oils. Representative, if not preferred, is CATALIX GS (Sandoz Chemicals Corporation). This paste-type product is a proprietary mixture in the fatty-acid amine condensation product family of chemicals, and it contains acetic acid.

The hides are tumbled in the CATALIX GS-containing solution for 25 to 35 and typically 30 minutes at a mildly elevated (100 to 115 and typically 110° F.) temperature. Then, the process agent selected to further waterproof the hides and improve their washability is added to the solution in the tanning vat. Hydrophobic silicones can be used to advantage to impart washability and water repellency to the hides at this stage. A representative and often preferred product of this character is DENSODRIN S (BASF Corporation). This proprietary product is a creamy paste which is soluble in water.

After the washability/waterproofing agent is added to the float in the tanning vat, tumbling of the hides in the process solution is continued for a period of 15 to 30 and typically 15 minutes; and the formic acid or other fixing agent is then added. Formic acid, if selected, is effective at a lower concentration than in the earlier process stage employing that compound as a fixative (0.5 as opposed to 2 percent) and is added to the float in three equal moieties, typically at 5–10 minute intervals. Tumbling of the hides in the tanning vat is continued for a period of 15 to 30 and typically 15 minutes after the fixative is added to the float solution.

The process is completed by draining the float solution from the tanning vat; washing the hides in room temperature water until clean to remove excess chemicals; and drying the clean hides.

As will be apparent to the reader by this juncture, hides are processed in accord with the principles of the present invention in a succession of aqueous floats which, except for washes and rinses, contain one or more active ingredients specifically selected to impart particular characteristics to the hides being processed. Exemplary products containing each of these ingredients and the concentrations in which they are used appear in Table 1 below. The balance of each solution is water.

TABLE 1

| Active Principle | Representative Product(s) | Range(s) | Concentration(s) Typically Preferred |
|---|---|---|---|
| Buffer | Sodium Formate | 0.5–1 | 1 |
| Character Builder | Chestnut Powder | 4–6 | 6 |
| | TERGOTAN EFB | 4–10 | 6 |
| | TERGOTAN MC-N | 2–8 | 4 |
| Softening Agent | DERMALIX C | 4–8 | 6 |
| | L-80 | 1–5 | 5 |
| Fixing Agent | BYSANTAN DLE | 0.25–0.5 | 0.3 |
| | CHROMITAN FM | 2–3 | 3 |
| | Formic Acid | 0.5–2.5 and 0.5 to 1 | 2 and 0.5 |
| Waterproofing Agent | OMBROPHOB M | 6–12 | 10 |
| Character Builder | CATALIX GS | 1–5 | 2 |
| Washability Imparting/ Waterproofing Agent | DENSODRIN S | 2–4 | 3 |

All percentages identified in Table 1 and elsewhere in this specification are weight percentages.

One of the important advantages of the present invention, discussed above, is that the process effluents have a significantly lower concentration of toxic chemicals. This was confirmed by an independent testing laboratory which reported that the effluents are burdened with substantially lower amounts of organic carbon, oil, and grease and that the quality of the effluents is furthermore superior because no phenols are present.

The following Material Safety Data Sheets are hereby incorporated by reference in this specification.

| Product | Product Number |
|---|---|
| TERGOTAN EFB | 284002 |
| TERGOTAN MC-N | 262493 |
| DERMALIX C | 240352 |
| L-80 | N.A. |
| BYSANTAN DLE | 510211 |
| CHROMITAN FM | 595072 |
| OMBROPHOB M | 238072 |
| CATALIX GS | 233612 |
| DENSODRIN S | 512618 |

Many changes may of course be made in the process as described above without exceeding the scope of the present invention. For example, the optional step of dyeing the hides may be carried out after, not before, the stage in which a softening agent is introduced and fixed in the pores of the hides being treated. The invention may also be embodied in many other forms without departing from the spirit or essential characteristics of the invention. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed is:

1. A method of converting a wet blue hide to a soft, supple leather, said method comprising the steps of:

contacting the wet blue hide with a buffering agent in a concentration and for a period of time effective to equalize the pH on the outer and flesh sides of the wet blue hide;

then contacting the wet blue hide with at least one tanning agent at a temperature and for a period of time effective to retan said hide;

then contacting the hide with one or more softening agents in an amount effective to soften said hide and thereby improve the feel of the leather into which the hide is converted;

further contacting the hide with an organic hydrophobe in an amount effective to impart water repellency to the leather; and contacting the hide with a cationic topping oil in an amount effective to impart a pleasant tactile character to the leather.

2. A method as defined in claim 1 in which the hide is contacted with one or more fixatives to permanently establish in the pores of the hide one or more substances with which the hide has previously been contacted.

3. A method as defined in claim 2 which includes at least two steps in which the hide is contacted with a fixative.

4. A method as defined in claim 3 in which the fixatives are selected from the group consisting of formic acid, an ammonium salt, and a chromium salt.

5. A method as defined in claim 2 in which the fixative is selected from the group consisting of formic acid, an ammonium salt, and a chromium salt.

6. A method as defined in claim 1 in which the hide is contacted subsequent to incorporation of the organic hydrophobe with an agent capable of equalizing the pH on outer and flesh sides of the hide and of increasing the pH of the hide throughout, thereby stabilizing the hydrophobe in the pores of the hide.

7. A method as defined in claim 6 in which the agent capable of equalizing the pH on outer and flesh sides of the hide and of increasing the pH of the hide throughout is a salt of formic acid.

8. A method as defined in claim 6 in which the organic hydrophobe is employed in an aqueous solution in a concentration of 6–12 percent by weight based on the weight of the solution.

9. A method as defined in claim 1 in which a plurality of softening agents are sequentially so contacted with the hide as to introduce the softening agents into the pores of the hide.

10. A method as defined in claim 9 in which the softening agents are employed in aqueous solutions and in concentrations such that the total concentration of the softening agents is 4–13 weight percent based on the weights of the solutions.

11. A method as defined in claim 9 which has further plural steps in which character builders are introduced into the pores of the hide.

12. A method as defined in claim 11 in which the character builders comprise one or more substances of vegetable origin, amino acid compounds, or acrylic polymers.

13. A method as defined in claim 11 in which the character builders are employed in aqueous solution and in which the character builders total 10–24 weight percent based on the weight of the solution.

14. A method as defined in claim 1 which further comprises introducing at least two agents into the pores of the hide to provide washability and waterproofability.

15. A method as defined in claim 14 in which the agents to provide washability and waterproofability respectively comprise a metallized organic compound and a hydrophobic silicone.

16. A method as defined in claim 1 in which the hide is further contacted with character builders in aqueous solution in at least two different steps, said character builders being the following in the stated concentrations by weight based on the weight of the solutions in which they are employed:

| Character Builder | Concentration (Percent) |
|---|---|
| Vegetative Material | 4–6 |
| Amino Acid Composition | 4–10 |
| Acrylic Polymer Composition | 2–8. |

17. A method as defined in claim 1 in which the hide is further contacted in one or more steps with a fixative selected from the following group, in aqueous solution, and in the stated concentration by weight based on the weights of the solutions in which they are employed to permanently establish in the pores of the hide one or more substances with which the hide has previously been contacted:

| Fixative | Concentration (Percent) |
|---|---|
| Ammonium Salt- and Organic Acid-Containing Composition | 0.25–0.5 |
| Formic Acid Salt [Compound] | 1–2.5 |
| Chromium Salt- and Organic Acid-Containing Composition. | 2–3 |

.

18. A method as defined in claim 1 in which the hide is contacted, subsequent to the contacting with the organic hydrophobe, with an aqueous solution containing from 0.5 to 1 weight percent of a formic acid salt based on the weight of the solution to stabilize the hydrophobe in the pores of the hide.

19. A method as defined in claim 1 which employs plural softening agents in aqueous solution, said agents being from 4 to 8 weight percent of a product containing an alkyl ester and an amine salt based on the weight of the solution in which the product is incorporated and from 1 to 5 weight percent of an oil-containing composition based on the weight of the solution in which the composition is incorporated.

20. A method as defined in claim 1 which further includes the step of introducing one or more substances into the pores of the hide to provide washability and waterproofablility, said substances being selected from the following group and employed in the stated concentrations by weight, based on the weight of and aqueous solution in which they are employed:

| Substance | Concentration (Percent) |
|---|---|
| Composition Comprising | 6–12 |
| a Metallized Organic Compound or | 2–4. |
| Composition Comprising a Hydrophobic Silicone | |

21. A method as defined in claim 1 in which the buffering agent is employed in aqueous solution in a concentration of 0.5 to 1 weight percent based on the weight of the solution.

* * * * *